US006910523B2

(12) United States Patent
Fish et al.

(10) Patent No.: US 6,910,523 B2
(45) Date of Patent: Jun. 28, 2005

(54) STRIP CASTING APPARATUS

(75) Inventors: John Andrew Fish, Woonona (AU); Heiji Kato, Yokosuka (JP)

(73) Assignee: Castrip, LLC, Charlotte, NC (US)

( * ) Notice: Subject to any disclaimer, the term of this patent is extended or adjusted under 35 U.S.C. 154(b) by 31 days.

(21) Appl. No.: 10/614,144

(22) Filed: Jul. 7, 2003

(65) Prior Publication Data

US 2004/0108093 A1 Jun. 10, 2004

Related U.S. Application Data

(63) Continuation-in-part of application No. 09/980,735, filed on Oct. 31, 2001, now Pat. No. 6,588,492.

(30) Foreign Application Priority Data

May 3, 1999 (AU) ..... PQ 0071

(51) Int. Cl.[7] ..... B22D 11/06
(52) U.S. Cl. ..... 164/428; 164/438
(58) Field of Search ..... 164/428, 435, 164/438, 439

(56) References Cited

U.S. PATENT DOCUMENTS

| | | | | |
|---|---|---|---|---|
| 5,221,511 A | | 6/1993 | Fukase et al. | 266/45 |
| 5,385,199 A | | 1/1995 | Sakaguchi | 164/428 |
| 5,810,070 A | | 9/1998 | Osada et al. | 164/480 |
| 6,003,589 | * | 12/1999 | Folder | 164/428 |
| 6,012,508 | | 1/2000 | Folder | 164/480 |
| 6,070,647 | * | 6/2000 | Folder et al. | 164/480 |
| 6,073,680 | | 6/2000 | Folder | 164/480 |
| 6,095,233 | * | 8/2000 | Leabeater et al. | 164/480 |
| 6,125,917 | | 10/2000 | Cassar et al. | 164/428 |
| 6,453,986 | * | 9/2002 | Leabeater et al. | 164/483 |
| 6,588,492 | * | 7/2003 | Fish et al. | 164/428 |

FOREIGN PATENT DOCUMENTS

| | | | |
|---|---|---|---|
| AU | 63175/99 | 7/2000 | B22D/11/14 |
| EP | 0 829 320 A2 | 3/1998 | B22D/11/06 |
| GB | 2 317 132 A | 3/1998 | B22D/11/06 |

* cited by examiner

*Primary Examiner*—Kevin P. Kerns
(74) *Attorney, Agent, or Firm*—Barnes & Thornburg LLP

(57) ABSTRACT

Apparatus and method for casting metal strip by controlling the distance between the confining side plates confining the casting pool and the outer nozzle ends of discrete nozzle pieces of the delivery nozzle delivering the molten melt. The nozzle pieces defining the outer nozzle ends may be moved and control separately from the position of the confining plates, or with the position of the confining plates, by a nozzle delivery drive. The distance between the outer nozzle ends and the confining plates may be set before casting and maintained during casting with wear and thermal expansion of the confining plates, nozzle pieces, or both, or varied during the casting operation, to inhibit the formation of skulls in the casting pool and the formation of "snake eggs" in the cast strip.

9 Claims, 7 Drawing Sheets

STRIP CASTING APPARATUS

RELATED APPLICATIONS

This application is a continuation in part of U.S. patent application Ser. No. 09/980,735, filed Oct. 31, 2001, to issue Jul. 8, 2003 as U.S. Pat. No. 6,588,492, and claims priority from Australian provisional patent application Serial No. PQ 0071, filed May 3, 1999.

BACKGROUND AND SUMMARY

This invention relates to the casting of metal strip. It has particular but not exclusive application to the casting of ferrous metal strip.

It is known to cast metal strip by continuous casting in a twin roll caster. Molten metal is introduced between a pair of counter-rotated horizontal casting rolls which are cooled so that metal shells solidify on the moving casting roll surfaces and are brought together at the nip between the casting rolls to produce a solidified strip product delivered downwardly from the nip. The term "nip" is used herein to refer to the general region at which the casting rolls are closest together. The molten metal may be poured from a ladle into a smaller vessel or series of smaller vessels from which it flows through a metal delivery nozzle located above the nip, so forming a casting pool of molten metal supported on the casting roll surfaces of the rolls immediately above the nip. This casting pool may be confined between side confining plates or dams held in sliding engagement adjacent the ends of the casting rolls.

Although, twin roll casting has been applied with some success to non-ferrous metals which solidify rapidly on cooling, there have been problems in applying the technique to the casting of ferrous metals which have high solidification temperatures and tend to produce defects in the cast strip caused by uneven solidification on the casting roll surfaces of the rolls. One particular problem arises from the formation of pieces of solid metal known as "skulls" in the casting pool in the region of the side confining plates. These problems are exacerbated when efforts are made to reduce the superheat of the incoming molten metal. The rate of heat loss from the melt pool is greatest near the confining plates due primarily to additional conductive heat transfer through the confining plates and the roll ends. This high rate of local heat loss is reflected in the tendency to form "skulls" of solid metal in this region which can grow to a considerable size and go through the nip between the rolls causing defects in the strip generally known as "snake eggs". It is therefore very important to maintain constant pool conditions in the casting pool in the region of the side confining plates.

We have found that the distance between the nearest nozzle ends of in the delivery nozzle and the inner faces of the confining side plates is particularly important to inhibit formation of "skulls" in the casting pool in this region. We have determined that significant flow changes are brought about by variation in this distance. Variation in this distance may be brought about by inaccurate location of the confining plates or the delivery nozzle during set up, or by subsequent change in the distance due to thermal expansion and wear in the confining plates or the nozzle openings of the delivery nozzles during casting. This problem remains even if the delivery nozzle is designed specifically to provide an increased flow of metal to the "triple point" regions (i.e., where the confining plates and casting rolls meet at the meniscus regions of the casting pool) and increase the heat input to these regions of the casting pool. Examples of such nozzles may be seen in U.S. Pat. Nos. 4,694,887, 5,221,511 and our earlier Australian Patent Application 35218/97 based on provisional Application P02367.

Although triple point pouring has been effective to reduce the formation of skulls in the triple point regions of the casting pool, it has not been possible completely to eliminate the problem. The generation of skulls and resulting strip defects has been found to be remarkably sensitive to even minor variations in the flow of metal into the triple point regions of the casting pool. Even minor changes in the distance between the nozzle ends (where the nearest nozzle openings are located) and the confining plates due to thermal expansion and/or wear has been found to be sufficient to cause defects in the strip. As the distances between the nozzle ends and the confining plates are reduced the downwardly inclined flow of metal from the triple point pouring passages in the ends of the nozzle impinges higher on the confining plates. This change can lead to the formation of skulls in the casting pool and subsequent snake egg defects in the strip. In extreme cases, changes in these distances can cause the poured molten metal to surge upwardly between the nozzle ends and confining plates, and spill over the upper edges of the confining plates.

This problem is addressed in our Australian Patent Application 63175/99 which discloses an improvement by which it is possible to maintain substantially constant spacing between the ends of the delivery nozzle and the confining plates with wear of the confining plates during the casting campaign, and which sets forth embodiments of the present invention. In Application 63175/99, there is disclosed apparatus for casting metal strip comprising:

- a pair of casting rolls forming a nip between them,
- an elongate metal delivery nozzle formed in a plurality of discrete elongate nozzle pieces disposed end to end,
- nozzle supports supporting the nozzle pieces such that the delivery nozzle extends above and along the nip between the casting rolls for delivery of molten metal to form a casting pool of molten metal supported on casting surfaces of the casting rolls above the nip,
- a pair of pool confining plates adjacent the ends of the nip,
- plate biases to bias the pool confining plates adjacent the ends of the casting surfaces of the casting rolls so that the confining plates move inwardly along the rolls to accommodate wear of the confining plates, and
- nozzle end shifters to shift the nozzle pieces having outer nozzle ends nearest the confining plates on the nozzle supports with inward movements matching the inward movements of said confining plates accommodating wear of the confining plates to maintain substantially constant spacings between the confining plates and the nearest nozzle ends.

In the specific apparatus disclosed in Australian provisional application PP8024, the nozzle end shifter comprises spacers disposed between the nearest outer nozzle ends and the side confining plates to set the spacings between said nozzle ends and the side plates so that the confining plates through the spacers push the ends of the delivery nozzle inwardly as the confining plates move inwardly under the influence of the biasing force to accommodate wear of the confining plates. This disclosure is also set forth in provisional application PQ0071, from which the present application claims priority.

An alternative apparatus also disclosed in Australian provisional application PQ0071 provides for a nozzle shifter to shift the outer nozzle ends to provide more reliable control of the distance between the confining side plates and the nearest outer nozzle ends during the casting campaign. This alternative apparatus for casting metal strip comprises:

a pair of casting rolls forming a nip between them, an elongate metal delivery nozzle formed in a plurality of discrete elongate pieces disposed end to end along the nip, nozzle supports supporting the nozzle pieces such that the delivery nozzle extends above the nip to discharge molten metal through the nozzle pieces to form a casting pool of molten metal supported by the casting rolls above the nip, a pair of pool confining plates adjacent the ends of the nip to confine the casting pool, plate biases to bias the pool confining plates adjacent end surfaces of the casting rolls to move the confining plates inwardly to accommodate wear of the plates, and nozzle end shifters to shift the nozzle pieces defining the outer nozzle ends of the delivery nozzle with inward movements matching the inward movements of said side plates accommodating wear of the side plates to maintain substantially constant spacings between the side plates and the nozzle ends, wherein the nozzle end shifters comprise a pair of moveable structures disposed one at each end of the casting roll assembly, drives to move the moveable structures longitudinally of the rolls, nozzle attachments to attach the moveable structures to the two nozzle pieces defining the outer nozzle ends nearest the confining plates so that those two nozzle pieces are moved with the movable structures, and controls responsive to inward advances of the confining plates along the casting rolls to cause the drives to move the moveable structures inwardly and shift said two nozzle pieces with inward movements matching inward movement of the confining plates.

The plate biases may comprise a pair of generally horizontally acting thrusters actuable to apply opposing inward closure forces to the confining plates. Said moveable structures may provide abutments against which the thrusters react to apply the inward moving forces to the confining plates.

The moveable structures may comprise a pair of carriages which carry the thrusters and which are moveable toward and away from another to enable the spacing between them to be adjusted so that the carriages can be preset before a casting operation to suit the width of the casting rolls.

The moveable structures may further comprise carriage drives acting between outer end parts of the moveable structures and the carriages to move the carriages toward and away from one another.

The carriage drives may comprise a pair of fluid operable cylinder units connected one to each of the carriages and to outer end parts of said moveable structures.

The drives may act on the outer end parts of the moveable structures.

The drives may comprise a pair of jacks connected to the outer end parts of the moveable structures. Those jacks may be electrically driven screw operated jacks.

The controls may be responsive to motion of the plate biases which produces inward movements of the pool confining plates. The controls may, for example, include transducers in the plate thrusters to produce control signals indicative of movement of the thrusters and plates and connected in a control circuit with the drives such that the drives cause corresponding movements of the moveable structures and therefore said two nozzle pieces.

Alternatively the controls may include inspectors, such a sensors or video cameras, to observe the position of the pool confining plates and to provide control signals dependant on observed changes in the position of those plates.

In addition, broadly disclosed is an apparatus for casting metal strip comprising:

(a) a pair of casting rolls forming a nip there between;

(b) a pair of confining plates adjacent the ends of the casting rolls;

(c) an elongated metal delivery nozzle having a plurality of discrete nozzle pieces disposed along the nip capable of discharging molten metal to form a casting pool supported on the casting rolls above the nip confined by the confining plates;

(d) nozzle supports capable of supporting the nozzle pieces defining outer nozzle ends of the delivery nozzle nearest the confining plates; and (e) delivery nozzle drives capable of moving the nozzle pieces defining said outer nozzle ends to control the distance between said outer nozzle ends and said confining plates.

The nozzle ends in the nozzle pieces nearest the confining plates have nozzle openings to deliver molten metal to the triple point region of the casting pool.

The nozzle pieces are moved by the nozzle drives with or along the nozzle supports depending on the embodiment. In either event, the delivery nozzle drives may vary the distance between the confining plates and the outer nozzle ends nearest the confining plates to maintain appropriate flow of molten metal into the triple point region while allowing for thermal expansion and wear of the nozzle pieces and confining plates and inhibit formation of skulls in the casting pool. The apparatus may also comprise an inspector, such as a video camera, to allow an operator to monitor the melt flow in the triple point region and electrical controls actuated by an operator may energize the nozzle drives to move the nozzles pieces relative to the confining plates.

The apparatus for casting metal strip may have the delivery nozzle drive capable of moving the nozzle ends nearest the confining plates to maintain a set distance between the outer nozzle ends and the confining plates with thermal expansion and wear of the confining plates, the nozzle ends or both. The apparatus for casting metal strip may have said set distance set and maintained on the order of 15 millimeters and less, and may be between about 7 and 9 millimeters. The apparatus may further comprise inspectors, such sensors or video cameras, to sense or observe the distance of the confining plates from the outer nozzle ends, and provide electrical signals, automatically or by an operator, to the delivery nozzle drives to maintain the distance between the confining plates and the outer nozzle ends with thermal expansion and wear or the confining plates or the outer nozzle ends, or both.

The broad apparatus may also comprise biases to force the confining plates inwardly adjacent the ends of casting rolls. The biases may be separate from the nozzle drives to allow the distance between the outer nozzle ends and the confining plates to be varied separate from the movement of the confining plates, or the biases may be provided with the nozzle drives if the distance between the outer nozzle ends and the confining plates are to be maintained at a set distance. Alternatively, the biases may be provided by a separate drive such as a servo mechanism.

Also broadly disclosed is a method for casting metal strip comprising the steps of:

(a) assembling a pair of casting rolls to form a nip between the casting rolls and a pair of confining plates adjacent the ends of the casting rolls pool, (b) assembling an elongated metal delivery nozzle with a plurality of nozzle pieces disposed along the nip capable of discharging molten metal to form a casting pool supported on the casting rolls above the nip confined by the confining plates, and (c) moving the nozzle pieces defining the outer nozzle ends of the delivery nozzle to control the distance between the confining plates and said outer nozzle ends.

The method may vary the distance between the confining plates and the outer nozzle ends nearest the confining plates to maintain appropriate flow of molten metal into the triple point region while allowing for thermal expansion and wear of the nozzle pieces and confining plates, and inhibiting formation of skulls in the casting pool. The method may also comprise inspecting the casting pool in the triple point region, as with a video camera, to allow an operator to monitor the melt flow in that region and control movement of the nozzle drives and in turn the nozzles pieces defining the outer nozzle ends relative to the confining plates.

Alternatively, the method for casting metal strip may include the step of moving the nozzle pieces defining the outer nozzle end nearest the confining plates to maintain a set distance between the nozzle openings and the confining plates with thermal expansion and wear of the confining plates, the nozzle ends or both. The method of casting metal strip may include setting the distance between the confining plates and the nearest nozzle ends on the order of 15 millimeters or less and may be between about 7 and 9 millimeters, and maintaining said set distance during the casting campaign. The method may also comprise the further step of inspecting the distance of the confining plates from the outer nozzle ends, and providing electrical signals to control circuits of the delivery nozzle drives to maintain the set distance between the confining plates and the outer nozzle ends with wear and thermal expansion of the confining plates or the outer nozzle ends, or both.

The method may also comprise the step of biasing the confining plate inwardly adjacent the end of the casting rolls. This step may be done separately from moving the nozzle pieces defining the outer end of the delivery nozzle, or may be done along with the step of moving said nozzle pieces if the distance between the confining plates and the outer nozzle ends is to be set and maintained during the casting campaign.

BRIEF DESCRIPTION OF THE DRAWINGS

In order that the invention may be more fully explained, one particular embodiment will be described in some detail with reference to the accompanying drawings in which.

DETAILED DESCRIPTION OF THE PREFERRED EMBODIMENT

Figure 1:
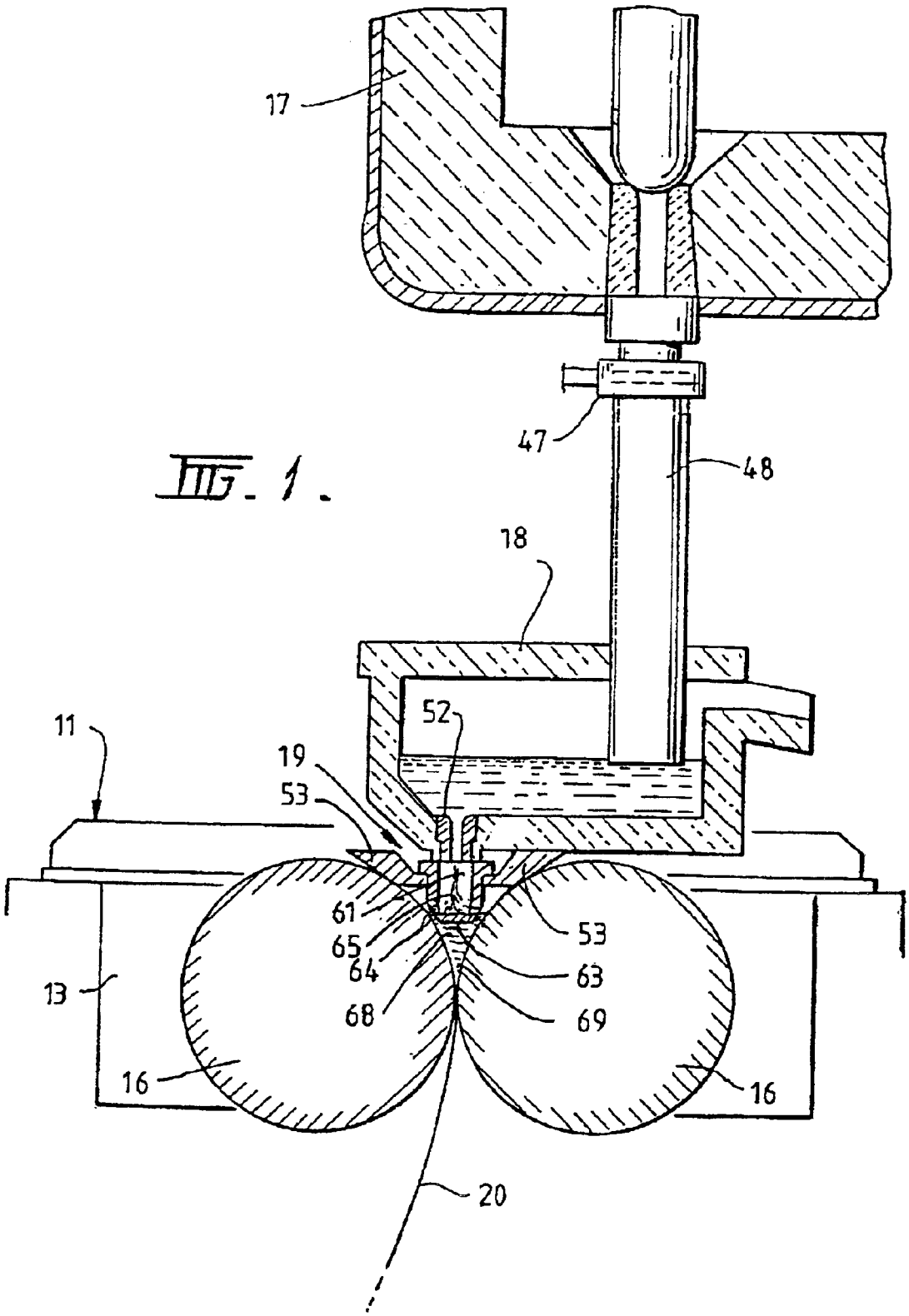
FIG. 1 is a vertical cross section through a strip caster constructed in accordance with the present invention.

The illustrated caster comprises a main machine frame 11 which supports a casting roll module in the form of a cassette 13 which can be moved into an operative position in the caster as a unit, and can readily be removed as needed when the casting rolls are to be replaced. Cassette 13 carries a pair of casting rolls 16 arranged generally in parallel to form a nip 69 there between. Molten metal is supplied during a casting operation, a campaign, from a ladle (not shown) via a tundish 17, distributor 18 and delivery nozzle 19 to create a casting pool 68 supported on the casting rolls 16 above the nip. The casting pool 68 is confined at the ends of the nip by a pair of side confining plates 56 as explained below. Casting rolls 16 are water cooled so that melt shells solidify on the moving roll surfaces and are brought together at the nip 69 to produce a solidified strip product 20 extending downwardly from the nip. This product may be cooled and fed to a standard coiler.

Casting rolls 16 are counter-rotated by a casting roll drive through drive shafts from an electric motor (not shown) connected through a transmission mounted on the main machine frame. The drive shafts can be disconnected from the transmission when the cassette is to be removed. Rolls 16 may each have copper peripheral walls forming the casting surfaces of the roll, with a series of longitudinally extending and circumferentially spaced internal water cooling passages. Water cooling passages are supplied with cooling water through the roll ends from water supply ducts in the roll drive shafts which are connected to water supply hoses through rotary glands. The roll may typically be about 500 mm diameter and up to 2000 mm long, and produce cast strip product approximately the width of the rolls.

The molten metal is supplied to the apparatus by a ladle (not shown) of entirely conventional construction. The ladle is supported on a rotating turret so that it can be brought into position over the tundish 17 to fill the tundish with molten metal. The tundish may be fitted with a sliding gate valve 47 actuable by a servo cylinder to allow molten metal to flow from the tundish 17 through the valve 47 and refractory shroud 48 into the distributor 18.

The distributor 18 is formed as a wide dish made of a refractory material such as magnesium oxide (MgO). One side of the distributor 18 receives molten metal from the tundish 17 through shroud 48 and the other side of the distributor 18 is provided with a series of longitudinally spaced metal outlet openings 52. The lower part of the distributor 18 carries mounting brackets 53 for mounting the distributor onto the main caster frame 11 when it is installed in its operative position.

Figure 2A:
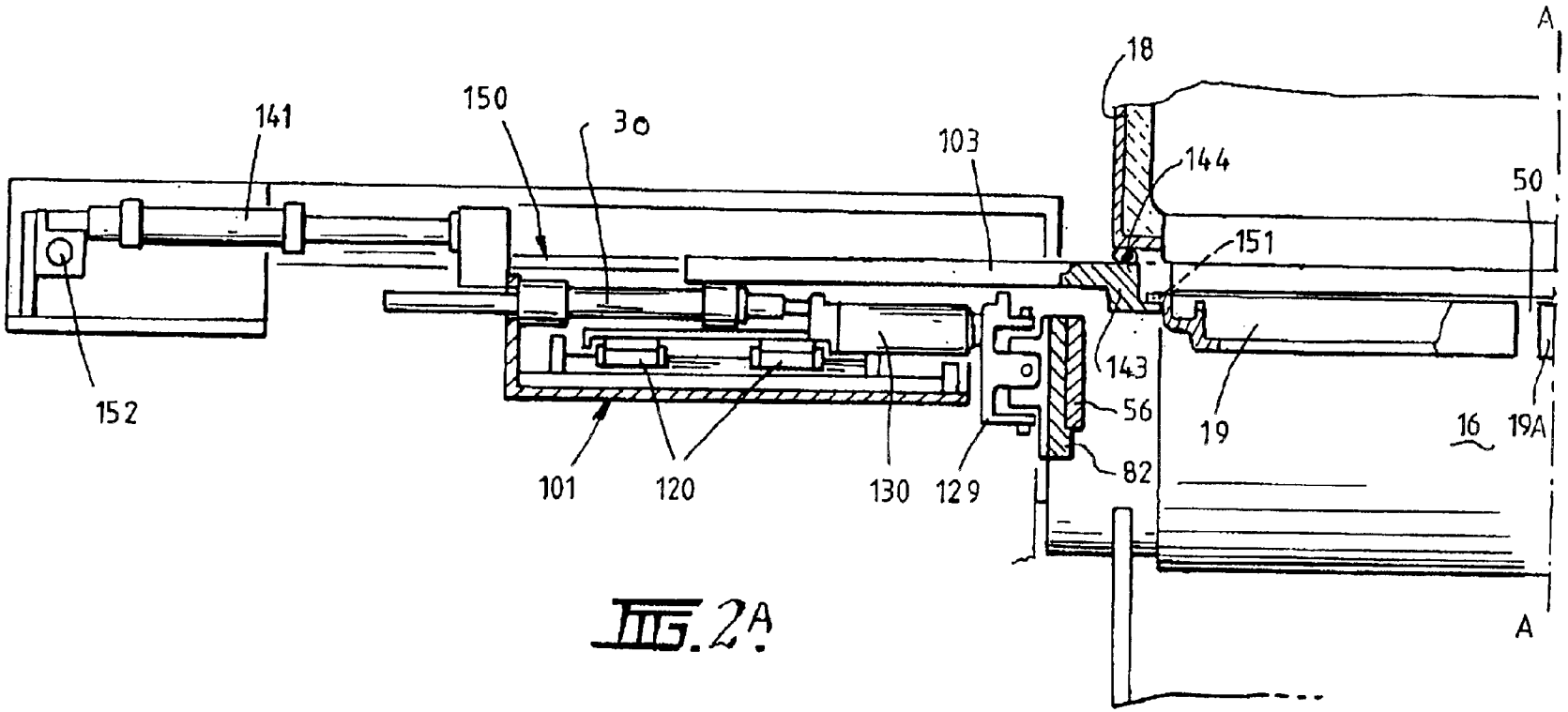
FIGS. 2A and 2B join on the line A—A to form a longitudinal cross section through important parts of the caster.
Figure 2B:
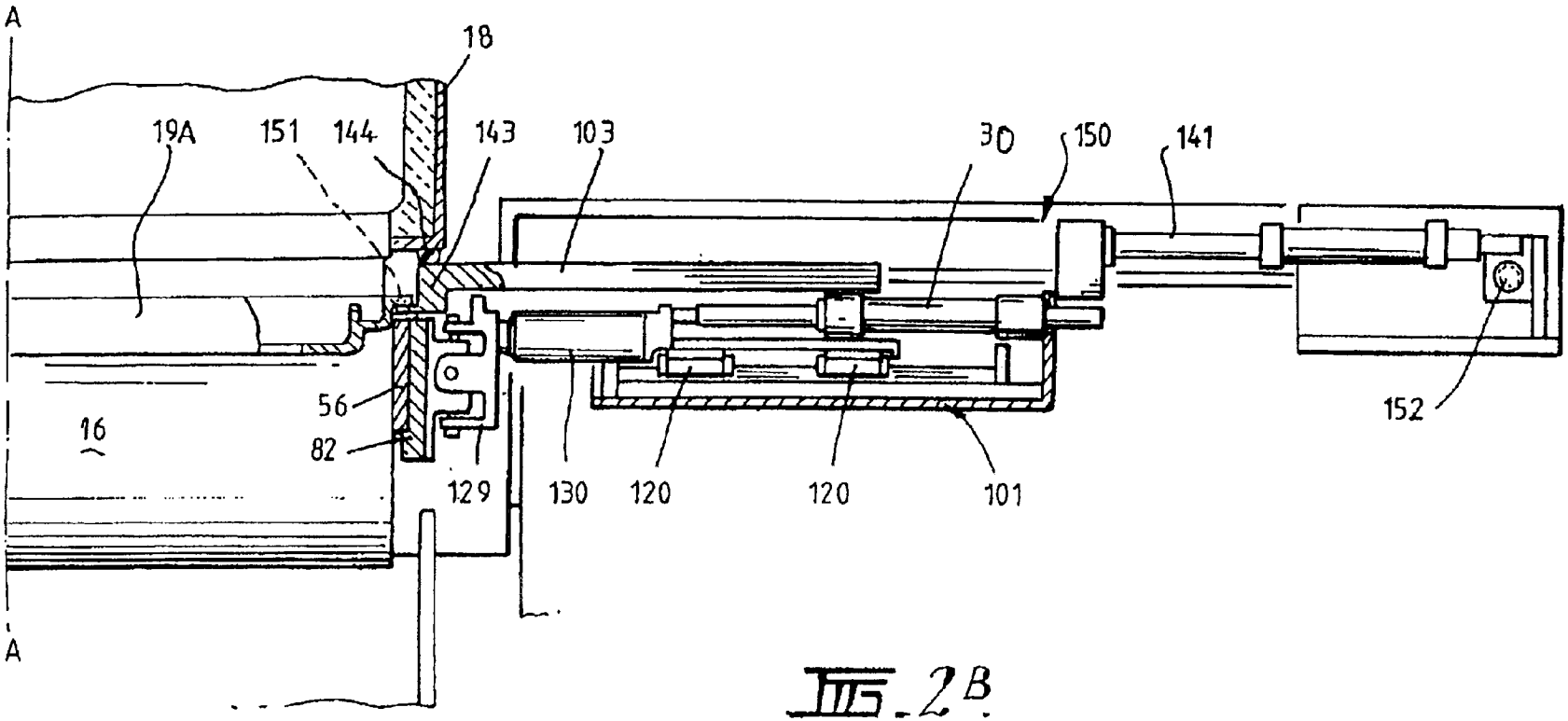
Figure 3:
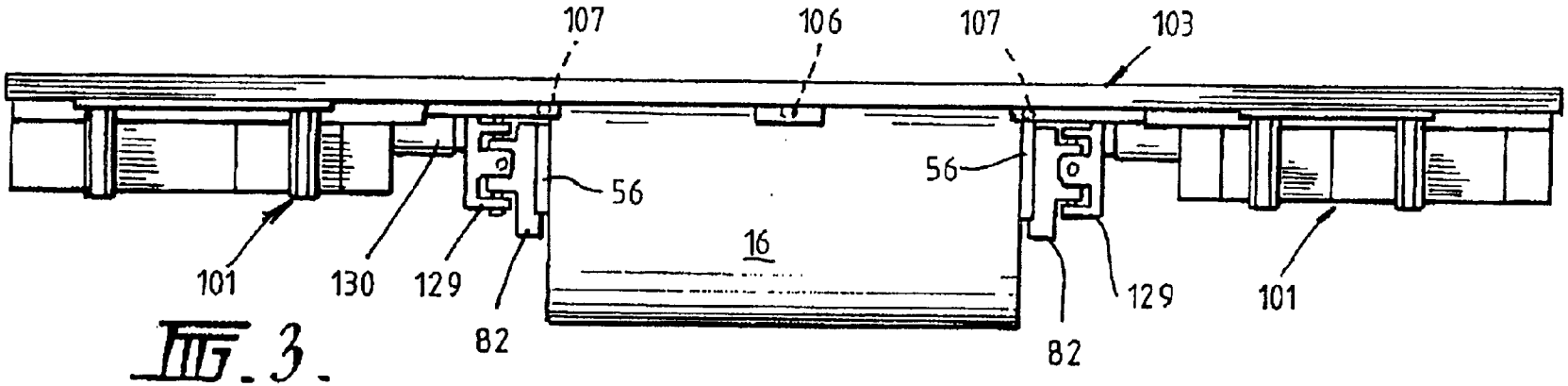
FIG. 3 is a side elevation of parts of the caster which provide support for a metal delivery nozzle.

Delivery nozzle 19 may be made of two discrete elongate pieces 19A formed as substantially identical segments made of a refractory material such as alumina graphite. Pieces 19A may be in two half segments, although more than two nozzle pieces may be used to form delivery nozzle 19 and in different sizes and shapes if desired. Nozzle pieces may also not be substantially identical in size and shape, although this does facilitate fabrication. The nozzle pieces 19A are supported so as to be disposed in end to end relationship along the nip with a gap 50 between them (see FIG. 2A), so that the nozzle pieces 19A defining the outer nozzle ends can be moved inwardly toward each other as explained below.

Figure 4:
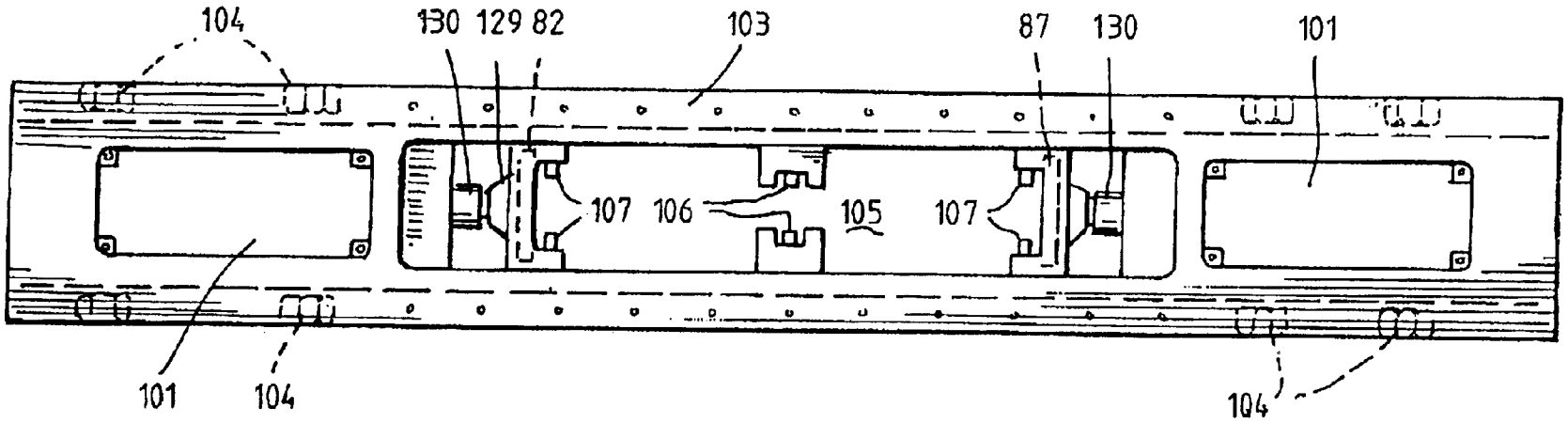
FIG. 4 is a plan view of the components shown in FIG. 3.
Figures 5, 6, 7:
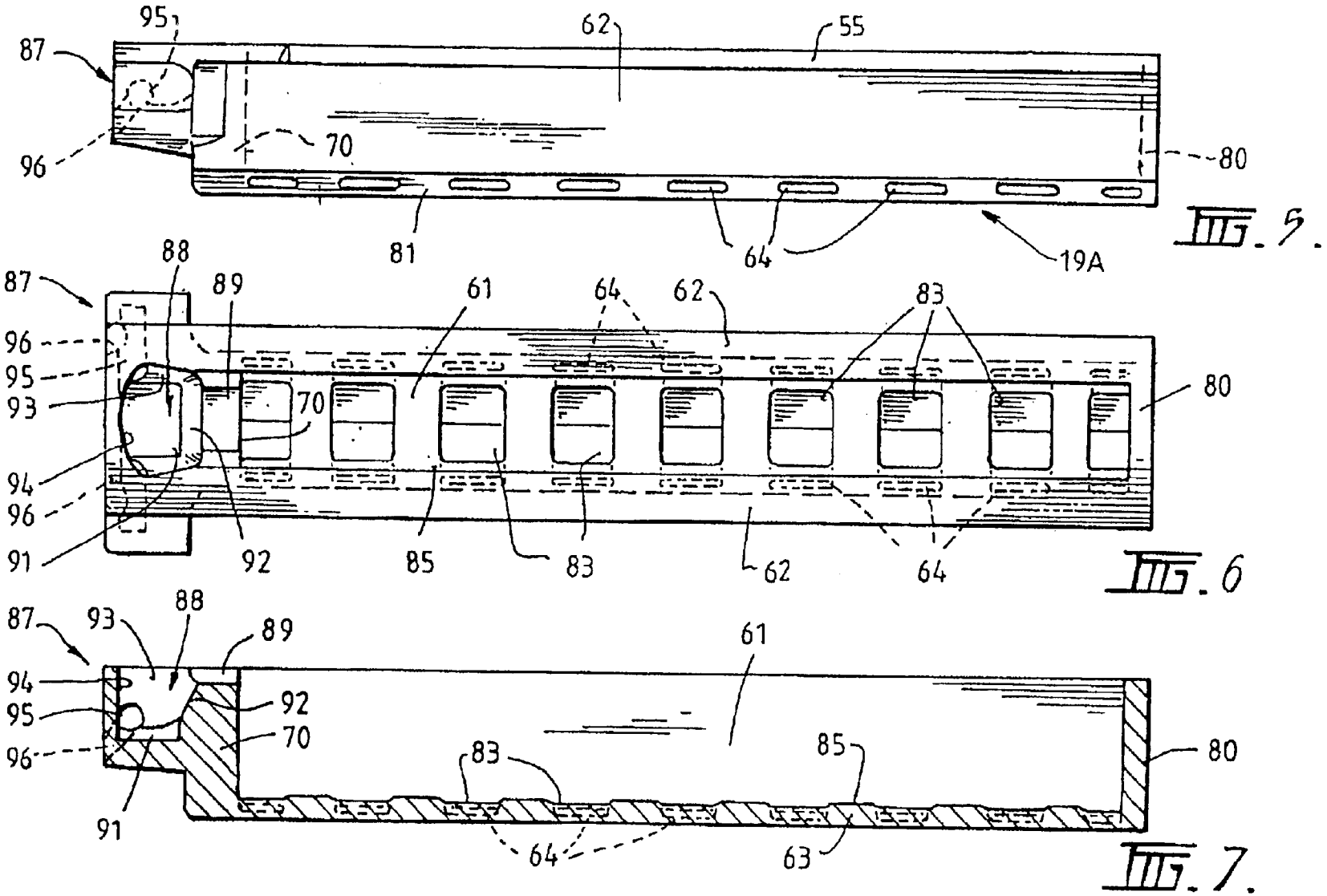
FIG. 5 is a side elevation of a one nozzle piece of the metal delivery nozzle.
FIG. 6 is a plan view of the nozzle piece shown in FIG. 5.
FIG. 7 is a longitudinal cross-section through the delivery nozzle piece.
Figure 8:
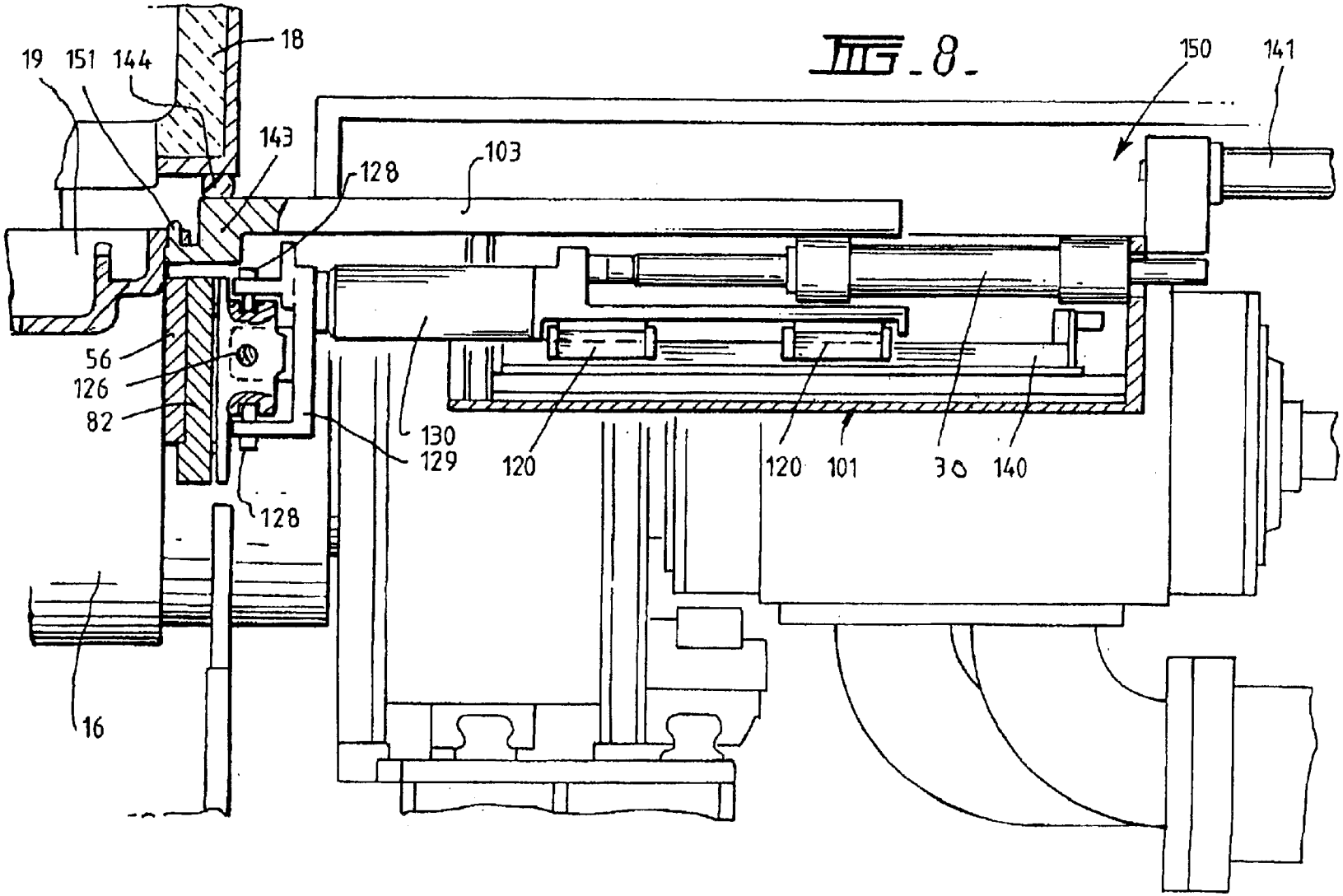
FIG. 8 is an enlarged vertical cross section through components at one end of the caster.
Figure 9:
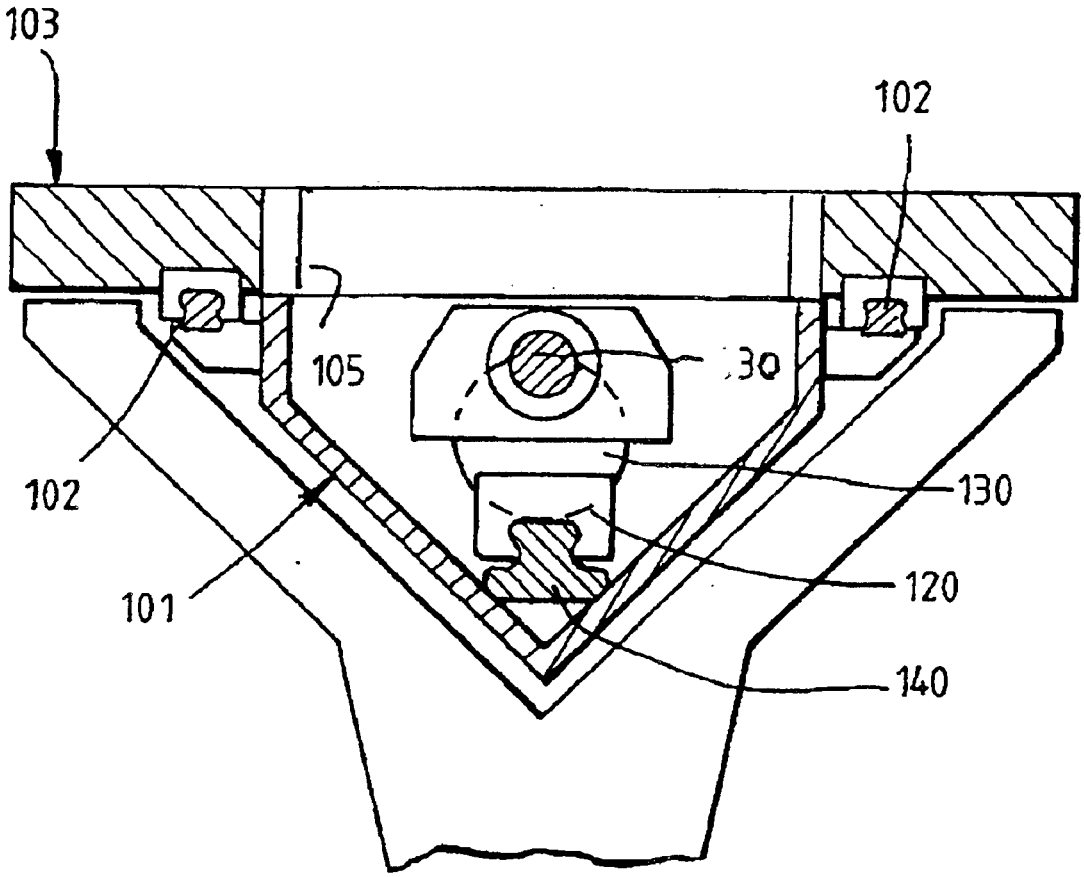
FIG. 9 is a transverse cross section through the components shown in FIG. 8.

The construction of the nozzle pieces 19A formed as two half segments is illustrated in FIGS. 4 to 6. Each nozzle piece is of generally trough formation so that the nozzle 19 defines an upwardly opening inlet trough 61 to receive molten metal flowing downwardly from the openings 52 of the distributor 18. Trough 61 is formed between nozzle side walls 62, and with end walls 70 to be positioned nearest the confining plates 56 as explained below. Trough 61 also may be considered to be transversely partitioned at the inner end by end wall 80 of the nozzle piece 19A, so that the end walls 80 of the two nozzle pieces 19A face each other spaced apart to form the gap 50. The bottom of the trough 61 is closed by a horizontal bottom floor 63 which meets the trough side walls 62 at chamfered bottom corners 81. The nozzle piece 19A is provided at these bottom corners with a series of side openings in the form of longitudinally spaced elongate slot openings 64 arranged at regular longitudinal spacing along the nozzle piece. Slot outlet openings 64 are positioned to provide for egress of molten metal from the trough 61 at the level of the trough floor 63. The trough floor is provided adjacent the slots 64 with recesses 83 which slope outwardly and downwardly from the center of the floor toward the slots and the slots continue as extensions of the recesses 83 to slot outlet openings 64 disposed in the chamfered bottom corners 82 of the nozzle beneath the level of the upper floor surface 85.

The outer nozzle ends of the nozzle pieces 19A nearest the confining plates 56 are denoted generally as 87. The outer nozzle ends 87 are provided with triple point pouring nozzle end formations and openings extending outwardly beyond the nozzle end wall 70. Each outer nozzle end 87 may have a small open topped reservoir 88 to receive molten metal from the distributor 18, this reservoir being separated from the trough 61 of the nozzle by the end wall 70. The upper end 89 of end wall 70 is lower than the upper edges of the trough 61, and the outer parts of the reservoir 88 can serve as a weir to allow back flow of molten metal into the main part of the nozzle piece 19A from the reservoir 88 if the reservoir is over filled, as will be more fully explained below.

Reservoir 88 is shaped as a shallow dish having a flat floor 91, inner and side faces 92, 93 and a curved upright outer face 94. Although side faces 92, 93 as shown are inclined to the vertical, they may be formed to stand essentially vertically from the floor 91. A pair of triple point pouring passages 95 extend laterally outwardly from reservoir 88 just above the level of the floor 91 to connect with triple point pouring outlets 96 in the undersides of the outer nozzle ends 87, the outlets 96 being angled downwardly and inwardly to deliver molten metal into the triple point regions of the casting pool 68.

Molten metal falls from the outlet openings 52 of the distributor 18 in a series of free-falling vertical streams 65 into the bottom part of the trough 61 of each nozzle piece 19A. Molten metal flows from the trough 61 of the nozzle piece through the side openings 64 to form a casting pool 68 supported on the casting rolls 16 above the nip 69.

As previously described, the casting pool 68 is confined at the ends of the nip 69, adjacent the end of the casting rolls, by a pair of confining plates 56 which are held against stepped ends of the casting rolls when the roll cassette is in its operative position. Confining plates 56 are made of a strong refractory material, for example boron nitride, and have scalloped side edges to match the curvature of the stepped ends of the casting rolls. The confining plates 56 are mounted in plate holders 82 which are movably biased by, for example, conventional servo mechanisms (not shown) to bring the confining plates into engagement with the stepped ends of the casting rolls to confine the molten pool of metal formed on the casting rolls during a casting operation.

Removable roll cassette 13 may be constructed in the manner described in our Australian Patent Application 84244/98, so that the casting rolls 16 can be set up and the nip between them adjusted before the cassette is installed in operating position in the caster. Details of the cassette construction, which are fully described in Patent Application 84244/98, form no part of the present invention and need no further description in this context.

To provide the delivery nozzle drive for the nozzle pieces 19A, a pair of carriages denoted generally as 101 are disposed one at each end of the casting roll assembly, and moveable toward and away from one another to enable the spacing between them to be adjusted. The carriages 101 may be preset before a casting operation to suit the width of the casting rolls for the strip to be cast, and to allow quick roll changes for differing strip widths. Carriages 101 are hung from tracks 102 on the under side of a fixed rectangular plate frame 103, which is mounted on the main machine frame by clamps 104, to extend horizontally above the casting rolls and to extend beyond them at the two ends of the caster. Rectangular plate frame 103 is disposed beneath the metal distributor 18 and has a central rectangular opening 105 to receive the metal delivery nozzle 19. The mid-part of frame 103 is provided with inwardly projecting delivery nozzle supports 106 to engage upper flanges at the inner ends 80 of the two nozzle pieces 19A, whereas the outer nozzle ends 87 of the nozzle pieces 19A are supported on nozzle support pins 107 mounted on the inner ends of the two carriages 101 so as to project, inwardly of the rectangular fixed frame opening 105 and to be moveable in and out with the carriages 101.

Optionally, confining plates 56 may be mounted on carriages 101 or separately mounted and biased. The confining plates 56 may be separately mounted and biased where it is desired to control the position of the outer nozzle ends 87 separate from the position of the confining plates 56. Alternatively, if the nozzle pieces 19A and the confining plates 56 are to be moved controlled together, confining plates 56 in holders 82 are pivotally mounted connected to the thrusters 30 so that the confining plates can tilt about the pivot connections and the thrusters can apply opposing forces on the confining plates through the pivots. The pivot connections are provided in such a way that each confining plate can rock longitudinally of the casting rolls by pivoting movement about a horizontal pivot axis transverse to the rolls and can rock laterally of the rolls by pivoting movement about a vertical pivot axis perpendicular to the horizontal pivot axis, the pivoting movement of the confining plates being confined to movements about those two specific axes so that other rotation of the plates is prevented.

In this way, each side plate holder 82 may be pivotally connected by horizontal pivot pin 126 and a pair of vertical pivot pins 128 to a thruster body 129 at the end of a thruster rod 130 of the respective thruster 30. Thruster rod 130 is then supported by a pair of bearings 120 on a track 140 on the carriage 101. The vertical pivot pins 128 are fixed to thruster body 129 and fit into elongate slots in the plate holder 82. The slots are elongate in the direction longitudinal to the thruster 30 to leave small clearance gaps about the pivot pins 128 which permit limited rocking movement of the plate holder about horizontal pin 121 longitudinally of the rolls. Horizontal pivot pin 126 is also mounted on the thruster body 129 and engages an internally convex bearing in the plate holder 82 so that the plate holder can rock laterally of the casting rolls about the vertical axis defined by the pivot pins 128. The degree to which the plate holder 82 is free to rock in this manner may be limited by engagement with stops on the thruster body 129.

Also, if the confining plates are supported by the carriages 101, the horizontal pivot pins 126 are located at such a height above the level of the nip between the casting rolls 16 that the effect of the outward pressure on the side plates due to the molten metal in the casting pool is such as to rotationally bias the confining plates 56 about the pivots in such directions that their bottom ends are biased inwardly so as to produce increased sealing pressure at the bottom of the casting pool. The arrangement permits tilting of the confining plates 56 so as to accommodate deformation of the end surfaces of casting rolls 16 due to thermal expansion during casting and at the same time maintains a bias which increases the sealing forces at the bottom of the casting pool so as to counter-act the increased hydrostatic pressure at the bottom of the pool where there is the greatest tendency for leakage.

Appropriate positioning of the pivots will depend on the diameter of the casting rolls, the height of the casting pool and thickness of the strip being cast. The manner in which correct positioning of the pivots can be determined is fully described in our Australian Patent 693256 and U.S. Pat. No. 5,588,479.

Whether the confining plates 56 are supported from the carriages 101 or separately supported, carriages 101 can be moved along the tracks 102 on frame 103, along the nip 69, by operation of a pair of fluid operated carriage positioning cylinder units 141, which may be pneumatically or hydraulically operated, fixed to the outer ends of carriages 101 and to a pair of electrically operated screw jacks 152 mounted on the machine frame. Cylinder units 141 may have two fixed positions so that they can set the carriages 101 in two alternative positions for two different cast strip widths. The setting of the carriages 101 moves the outer delivery nozzle support pins 107 into positions to support outer nozzle ends 87 of the nozzle pieces 19A appropriate to the width of the strip to be cast. If the confining plates 56 are supported by the carriages 101, the setting of the carriages in this way also automatically sets the plate holders 82 in appropriate positions so as to be brought into engagement and firmly pressed against the ends of the casting rolls by operation of the thrusters 30, and set the distance between the outer nozzle ends and the confining plates maintained.

Whether the confining plates 56 are supported from the carriages 101 or separately supported, carriages 101 also carry inner bridges 143 which seal against the outer ends of the distributor 18 via seals 144. The bridges 143 are located directly above the confining plate holders 82 and will thus fit against the outer ends of the distributor 18 of appropriate width chosen for the strip to be cast, thereby to provide a sealed enclosure above the casting pool 68 to enable casting in an inert atmosphere. One or both bridges 143 may also serve as camera supports to support casting pool observation cameras to monitor the condition of the casting pool during casting, particularly in the triple point region.

With the above construction, movement of the carriages is effective to automatically position the bridges 143 with the casting pool seals 144 and the casting pool observation cameras without the need for individual adjustment or setting of any of these components. Also, if the confining plates are attached to the carriages 101, this also sets the position of the confining plates appropriate to the width of the strip to be cast.

During casting, the nozzle pieces 19A undergo very significant thermal expansion through contact with the molten steel at temperatures of the order of 1570° C. or more. In a typical installation, each nozzle piece 19A may for example be about 650 cm long and the thermal expansion may produce a change in length of up to 12 mm. With the presently described apparatus and method, the distance between the outer nozzle ends and the confining plates will usually be set before casting on the order of 15 millimeters or less, and may be 7 to 9 millimeters to produce effective triple point pouring of molten metal along the confining plate and inhibiting the formation of "skulls" in the casting pool.

Further, without the presently described apparatus and method, the thermal expansion of the nozzle piece can lead to significant reduction in the distance between the outer nozzle ends and the confining plates during casting, causing the molten metal leaving the triple point pouring passages 95 to impinge on the upper parts of the confining plates above the casting pool leading to the formation of skulls and in extreme cases spilling of metal over the upper edges of the confining plates. Moreover the confining plates wear only at their margins which engage the stepped faces of the casting rolls. The inner parts of the confining plates between these margins remain unworn and as wear of the plates continues they are projected inwardly along the ends of the casting rolls decreasing the distance between the confining plates and the outer nozzle ends.

The present invention overcomes these problems by setting before casting and maintaining during casting the distance between the confining plates and the outer nozzle ends. In one embodiment, two moveable structures denoted generally as 150 which are connected to the outer nozzle ends 87 of the two nozzle pieces 19A by pins 151, and can be moved bodily in and out by the operation of a pair of screw jack drives 152. With this arrangement, the carriages 101 are incorporated with the carriage drive cylinders 141 in the moveable structures 150, which can be moved by operation of jacks 152 to move the two nozzle pieces 19A toward and away from each other. Pins 151 are located at the outer nozzle ends of the nozzle pieces 19A so the locations of the outer nozzle ends 87 are accurately set by the positions of moveable structures 150. During a casting operation, the screw jack drives can be operated control for wear and thermal expansion of the confining plates and nozzle pieces and to accurately control the distance between the outer nozzle ends and the confining plates. If the confining plates are attached to the carriage 101, this also enables the outer nozzle ends of the nozzle pieces to be accurately set in position relative to the confining plates prior to the casting operation and maintained in position during the casting operation. In either event, the positioning of the outer nozzle ends 87 is not significantly affected by thermal expansion of the nozzle pieces 19A because the outer nozzle ends are located through pins 51 and the nozzle pieces will expand inwardly, but the metal flow from the outer nozzle ends can be effected by thermal expansion and wear notably of the opening in the outer nozzle ends. For this reason, the confining plates 56 may be supported separately from the carriage 101 so that nozzle pieces 19A defining the outer nozzle ends 87 can be moved separately from the position and movement of the confining plates 56

In either case, screw jack drives 152 may be operated by electric motors connected into a control circuit receiving control signals determined by measurement of the distance variation between the outer nozzle ends and the confining plates. For example the thruster drives 30 may incorporate linear velocity displacement transducers to respond to the extension of the thrusters to provide signals indicative of inward movement of the carriages 101, and connected in the control circuit with position encoders (rotary) on the screw jack drives to determine the positions of the outer nozzle ends. Alternatively, small water cooled video cameras may be installed on the bridges 143 to directly observe the distances between the confining plates 56 and the outer nozzle ends 87 and to produce control signals to be fed to the position encoders on the delivery nozzle drives. With either arrangement, precise control of the distance between the inner faces of the confining plates and the faces of outer nozzle ends of the nozzle pieces may be maintained. Moreover these distances can be accurately set by independent operation of the delivery nozzle drives prior to casting.

What is claimed:

1. Apparatus for casting metal strip comprising:

(a) a pair of casting rolls forming a nip therebetween;

(b) a pair of confining plates adjacent the ends of the casting rolls;

(c) an elongated metal delivery nozzle having a plurality of discrete nozzle pieces disposed along the nip and capable of discharging molten metal to form a casting pool supported on the casting rolls above the nip confined by the confining plates;

(d) nozzle supports capable of supporting the nozzle pieces defining outer nozzle ends the delivery nozzle nearest the confining plates; and (e) delivery nozzle drives capable of moving the nozzle pieces defining the outer nozzle ends, nearest the confining plates to control the distance between the outer nozzle ends and the confining plates.

2. The apparatus for casting metal strip as claimed in claim 1, wherein the delivery nozzle drives move the nozzle supports separate from the movement of the confining plates to control the distance between the confining plates and the outer nozzle ends nearest the confining plates before casting.

3. The apparatus for casting metal strip as claimed in claim 1, wherein the delivery nozzle drive is capable of moving the nozzle pieces nearest the confining plates to maintain a distance between the nozzle pieces defining the outer nozzle ends and the confining plate with wear of the confining plates, the outer nozzle ends or both.

4. The apparatus for casting metal strip as claimed in claim 3 wherein the confining plates are biased by the delivery nozzle drive and said nozzle pieces defining the outer nozzle ends and the confining plates are moved together.

5. The apparatus for casting metal strip as claimed in claim 1 comprising in addition a bias to urge the confining plates inwardly toward each other.

6. The apparatus for casting metal strip as claimed in claim 5 wherein said bias to bias the confining plates inwardly toward each other is separate from the delivery nozzle drive.

7. The apparatus for casting metal strip as claimed in claim 5 wherein said bias to bias the confining plates inwardly toward each other operates with the delivery nozzle drive.

8. The apparatus for casting metal strip as claimed in claim 1, wherein a controlled distance is maintained on the order of 15 millimeters or less.

9. The apparatus for casting metal strip as claimed in claim 1 wherein a controlled distance is maintained between about 7 and 9 millimeters.

* * * * *